US005150793A

United States Patent [19]

Tannenbaum

[11] Patent Number: 5,150,793

[45] Date of Patent: Sep. 29, 1992

[54] DEVICE FOR INHIBITING REMOVAL OF AN ARTICLE FROM A BLISTER-TYPE CONTAINER

[75] Inventor: Michael A. Tannenbaum, Freehold, N.J.

[73] Assignee: PCI/Delvco, Inc., Ivyland, Pa.

[21] Appl. No.: 778,047

[22] Filed: Oct. 16, 1991

[51] Int. Cl.[5] ..... B65D 83/04

[52] U.S. Cl. ..... 206/531; 206/539; 221/72; 221/91; 221/302

[58] Field of Search ..... 206/531, 539; 221/5, 221/64, 72, 89, 91, 302

[56] References Cited

U.S. PATENT DOCUMENTS

| | | | |
|---|---|---|---|
| 2,534,815 | 12/1950 | Fields | 206/539 X |
| 3,324,996 | 6/1967 | Jordt | 206/531 |
| 3,504,788 | 4/1970 | Gray | 206/531 |
| 3,651,927 | 3/1972 | Richardson et al. | 221/302 X |
| 3,904,075 | 9/1975 | Richardson et al. | 221/5 |
| 4,511,032 | 4/1985 | Bush | 206/531 X |
| 4,817,819 | 4/1989 | Kelly | 206/531 X |
| 4,905,866 | 3/1990 | Bartell et al. | 221/5 |

FOREIGN PATENT DOCUMENTS

| | | | |
|---|---|---|---|
| 716303 | 9/1954 | United Kingdom | 221/69 |

*Primary Examiner*—Bryon P. Gehman

*Attorney, Agent, or Firm*—Panitch Schwarze Jacobs & Nadel

[57] ABSTRACT

The present invention is a device for inhibiting removal of an article from a blister-type container having at least one blister. The device includes a housing surrounding at least a portion of the container sized to permit movement of the container between first and second positions. The housing has a base positioned facing the blister-type container with at least one base opening in registry with the blister when the container is in the first position. The base opening is sized to permit passage of the article therethrough. The device also includes a biasing member for biasing the container toward the second position. When the container is in the second position, the base of the housing is positioned to inhibit removal of the article from the container. When the container is moved by an individual against the bias of the biasing member to the first position, the blister is in registry with the base opening to permit removal of the article by applying pressure to the outside surface of the blister to force the article to rupture the container and pass through the base opening.

12 Claims, 1 Drawing Sheet

DEVICE FOR INHIBITING REMOVAL OF AN ARTICLE FROM A BLISTER-TYPE CONTAINER

FIELD OF THE INVENTION

The invention relates to a device for inhibiting the removal of an article from a blister package-type container and, more particularly, to a child resistant device for inhibiting removal of an article from a blister package.

BACKGROUND OF THE INVENTION

Each year, thousands of children are injured by ingesting articles such as pharmaceutical products. For example, pills, tablets, and capsules of pharmaceutical products are often shaped, sized, and colored for the convenience of adults, yet represent an attractive hazard to young children unaware of the danger of ingesting such products. Young children may also be injured by playing with other pharmaceutical products, such as syringes.

Many pharmaceutical products, such as pills, tablets, capsules and syringes and other such articles are packaged in so-called blister-type packages or containers to facilitate removal but to inhibit contamination and product tampering. With such packages or containers, the article is typically sandwiched between a layer of transparent or translucent plastic in the form an outward extension, cavity or blister and a rupturable or puncturable layer. Force applied to the blister in the plastic layer is transmitted to the article, which ruptures or punctures the puncturable layer for removal of the article by the user.

While government regulations require child-resistant caps on bottles and vials of many pharmaceuticals, there exists a need in the art for a device which inhibits the removal by children of articles such as pills, syringes, etc. from blister-type containers.

SUMMARY OF THE INVENTION

Briefly stated, the present invention comprises a device for inhibiting removal of an article from a blister-type container. The container comprises a first generally flat sheet having first and second sides and at least one formed cavity or blister for accommodating the article. The container also comprises a puncturable generally flat second sheet having first and second sides. The first side of the second sheet engages a portion of the first side of the first sheet. The article may be removed from the container by applying pressure to an outside surface of the blister to force the article to puncture the second sheet. The device comprises a housing surrounding at least a portion of the container. The housing is sized to permit movement of the container between a first position and a second position. The housing has a base positioned facing the second side of the second sheet. The base includes at least one base opening in registry with the blister when the container is in the first position. The base opening is sized to permit passage of the article therethrough. The housing also has biasing means for biasing the container toward the second position. When the container is in the second position, the base of the housing is positioned facing the second side of the second sheet to inhibit removal of the article from the container. When the container is moved by an individual against the bias of the biasing means to the first position, the blister is in registry with the base opening to permit removal of the article by applying pressure to the outside surface of the blister to force the article to puncture the second sheet and pass through the base opening.

BRIEF DESCRIPTION OF THE DRAWING

The foregoing summary, as well as the following detailed description of a preferred embodiment of the invention, will be better understood when read in conjunction with the appended drawing. For the purpose of illustrating the invention, there is shown in the drawing an embodiment which is presently preferred, it being understood, however, that the invention is not limited to the specific methods and instrumentalities disclosed. In the drawing.

DESCRIPTION OF THE PREFERRED EMBODIMENT

Figure 1:
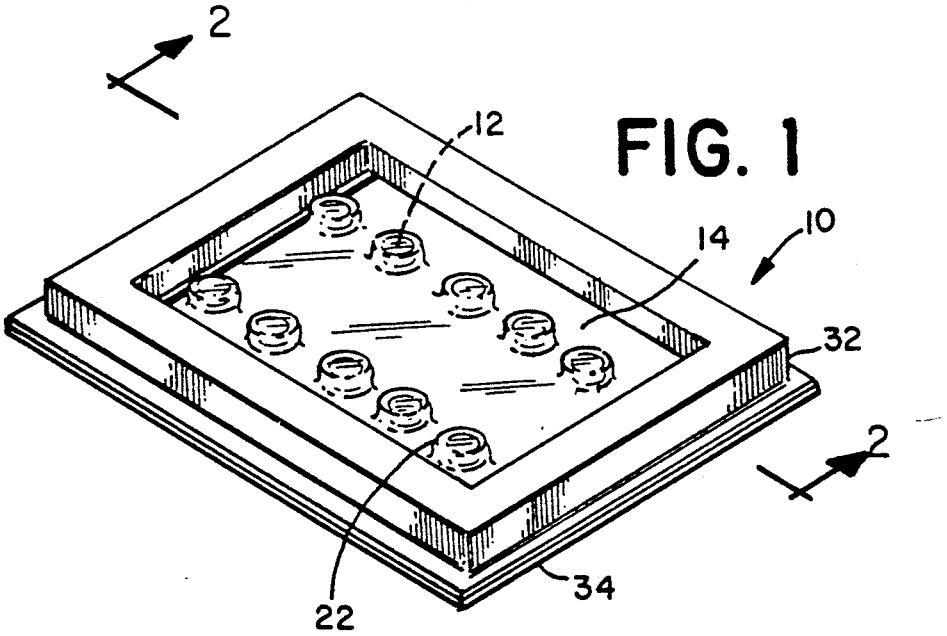
FIG. 1 is a perspective view of a device, in accordance with the present invention.

Certain terminology is used in the following description for convenience only and is not limiting. The words "outwardly", "right" and "left" designate directions in the drawing to which reference is made.

Referring to the drawing, wherein like numerals indicate like elements throughout, there is shown in FIG. 1 a device, generally designated 10, in accordance with the present invention. The device 10 is for inhibiting removal of an article 12 from a blister-type package or container 14.

As best shown in FIG. 1, the article 12 is preferably selected from the group consisting of pills, tablets, capsules, and syringes, although one of ordinary skill in the art would understand that the article 12 may be any article or product packaged in a blister-type package or container 14. One of ordinary skill in the art would also understand that the article 12 need not be restricted to pharmaceutical articles, but may be any article such as a screw, nut, bolt, razor blade, etc.

Figure 3:
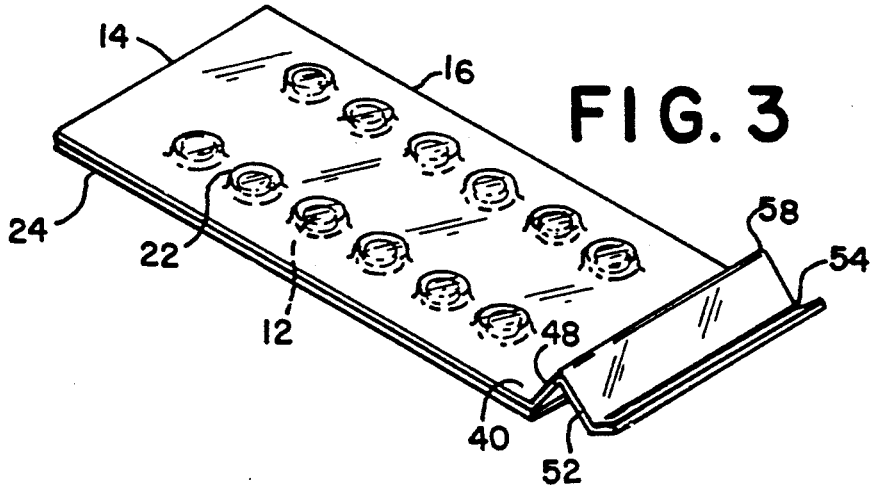
FIG. 3 is a perspective view of the container and biasing means of FIG. 1.

Preferably, the blister-type container 14 comprises a conventional blister package, best shown in FIG. 3. However, one of ordinary skill in the art would understand that the blister-type container 14 may take any shape or form in accordance with the spirit and scope of the present invention.

As best shown in FIG. 3, the container 14 comprises a first generally flat sheet 16. The first sheet 16 is formed from a generally compressible, formable material which would allow pressure applied to the first sheet 16 to be transmitted to the article 12 to remove the article 12 from the container 14.

The first sheet 16 is preferably formed from a formable polymeric material, such as one selected from the group consisting of polyvinyl chloride, styrene, polypropylene, barrex, aclar, PET, PETG, and APET including laminations or co-extrusions thereof in accordance with the chemical and/or mechanical characteristics of the article 12 and which may be formed to accommodate the size and shape of the article 12. One of ordinary skill in the art would understand, however, that the first sheet 16 may be formed from any other generally compressible, formable material such as aluminum.

Figure 2A:
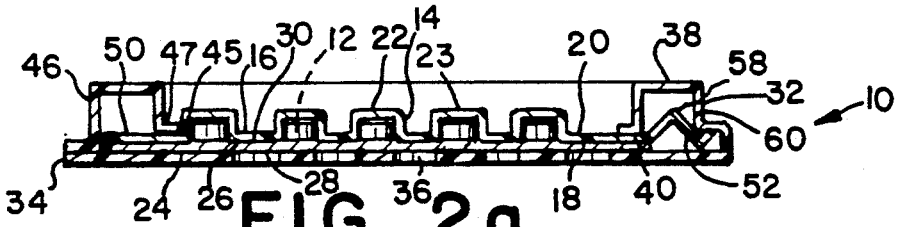
FIG. 2*a* is a cross-sectional view of the device taken along line 2—2 of FIG. 1, wherein the container is in a second position to inhibit removal of an article from the container.

As best shown in FIG. 2*a*, the first sheet 16 has a first side 18 and a second side 20. The first sheet 16 also has at least one generally outwardly extending, and preferably a plurality of, blisters 22 for accommodating the article 12. The interior dimensions of the blisters 22 preferably conform to the size and shape of the article 12. One of ordinary skill in the art would understand that the first sheet 16 need not be generally flat, and may have blisters 22 of any size and shape in keeping with the spirit and scope of the present invention.

As best shown in FIG. 3, the container 14 includes a rupturable or puncturable generally flat second sheet 24. The second sheet 24 is preferably generally rupturable by the article 12 in the area of the blister 22 when force is applied to a blister 22 of the first sheet 16 and thereby to the article 12. The force may be generated by the pressure of one or more fingers of an individual, for example.

Preferably, the second sheet 24 is a metallic foil, such as aluminum foil. However, one of ordinary skill in the art would understand that any other rupturable or puncturable material, such as a plastic material of the type described above in connection with the first sheet 16 or a paper material, may be used for the second sheet 24.

One of ordinary skill in the art would understand that the second sheet 24 need not be generally flat, but may have ridges or indentations, etc. Preferably, the second sheet 24 generally conforms in size to the first sheet 16, but one of ordinary skill in the art would understand that the second sheet 24 may be larger or smaller than the first sheet 16, as desired.

As best shown in FIG. 2*a*, the second sheet 24 has a first side 26 and a second side 28. The first side 26 of the second sheet 24 sealingly engages a portion 30 of the first side 18 of the first sheet 16. The portion 30 generally does not include the area of the blisters 22. Preferably, the first side 26 of the second sheet 24 is heat sealed or adhesively engaged to the portion 30 of the first sheet 16. For purposes of clarity in the drawing, the adhesive or heat seal coating is not shown. One of ordinary skill in the art would understand that the first side 26 of the second sheet 24 may be engaged with the portion 30 of the first sheet 16 by some other means.

The blister package or container 14 as described above is a typical blister package well known to those skilled in the art. An article 12 may be removed from the container 14 by applying pressure to an outside surface 23 of a blister 22 to force the article 12 to rupture or puncture the second sheet 24. One of ordinary skill in the art would understand that the pressure necessary to puncture the second sheet 24 with the article 12 is, among other criteria, a function of the shape and compressibility of the article 12, as well as the compressibility, thickness and type of material from which the first sheet 16 and second sheet 24 are formed. The pressure is generally that which is capable of being generated by one or more fingers of an individual.

As best shown in FIG. 1, the device 10 includes a housing 32. The housing 32 in the present embodiment is similar in appearance to a frame member and is preferably formed from a thermoplastic material such as polyvinyl chloride, styrene or any of the other polymeric materials discussed above which could be used to form the first sheet 16 of the blister container 14. However, one of ordinary skill in the art would understand that the housing 32 may be formed from any material sufficiently rigid to inhibit removal of the article 12 from the blister-type container 14. For example, the housing 32 could be made of paperboard or paperboard with a heat seal coating or a combination of paperboard and a polymeric material. Each component of the housing 32 may be formed from the same material or different materials, as desired.

Preferably, the components of the housing 32 are assembled by heat sealing, RF (radio frequency) or sonic welding, or by mechanical press fitting, however the components may be assembled by other conventional assembly means. The components of the housing 32 are preferably assembled after the container 14 has been positioned within the housing 32 to inhibit possible removal of the container 14 from the housing 32. However, one of ordinary skill in the art would understand that the housing 32 may be partially or fully assembled prior to positioning of the container 14 therein.

As best shown in FIG. 2*a*, the housing 32 surrounds at least a portion of the container 14 and preferably completely surrounds the container 14 in the manner of a picture frame, as illustrated in FIG. 1. The housing 32 is sized to permit sliding movement of the container 14 at least from left to right when viewing FIG. 2*a* between a first, dispensing position shown in FIG. 2*b* in which articles 12 may be removed from the container 14, and a second, non-dispensing position shown in FIG. 2*a* in which the removal of articles 12 from the container 14 is prevented. The housing 32 may be of any size or shape desired sufficient to accommodate the container 14 in keeping with the spirit and scope of the present invention.

The housing 32 has a base 34 positioned facing the second side 28 of the second sheet 24 of the container 14. Preferably, the base 34 is generally flat, although one of ordinary skill in the art would understand that the base 34 may be corrugated, for example.

Figure 2B:
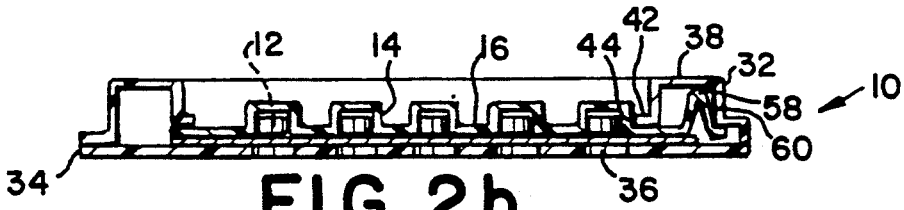
FIG. 2*b* is a cross-sectional view of the device taken along line 2—2 of FIG. 1, wherein the container is in the first position to permit removal of an article from the container.

As best shown in FIG. 2*b*, the base 34 includes at least one and preferably a plurality of openings 36 which are in registry with the blisters 22 of the blister-type container 14 when the container 14 is in the first position. The openings 36 may be of any size and shape sufficient to permit passage of the articles 12 therethrough.

Preferably, the housing 32 includes a first enclosure 38 in engagement with the base 34 and enclosing a first end 40 of the first sheet 16 and a biasing means (which will be discussed in greater detail later).

As best shown in FIG. 2*b*, the first enclosure 38 has an abutment 42 for contacting a portion 44 of the outside surface 23 of at least one blister 22, preferably one of the right most blisters 22 when viewing FIG. 2*b*, to restrict sliding movement of the first sheet 16 (toward the right when viewing FIG. 2*b*) with respect to the device 10 to establish the first, dispensing position and to provide proper registry between the blisters 22 and the base openings 36 as shown.

The device 10 also preferably includes a second enclosure 46 for inhibiting removal of the container 14 from the housing 32. The second enclosure 4 is in engagement with and preferably heat sealed to the base 34 and encloses a second end 50 of the first sheet 16. The second enclosure 46 may include a second abutment 47, shown in FIG. 2*a*, for contacting a second portion 45 of the outside surface 23 of at least one blister 22, preferably one of the left most blisters 22 when viewing FIG.

2*a* to restrict sliding movement of the first sheet 16 (toward the left when viewing FIG. 2*a*) with respect to the device 10 to establish the second position.

As best shown in FIG. 3, the device 10 preferably includes a biasing means. The biasing means in the present embodiment has a first end 48 in communication with a first end 40 of the first sheet 16. Preferably, the biasing means and the first sheet 16 are formed together from the same material. It is further preferred that the biasing means comprises at least one and preferably two or more shapes or folds 54, preferably accordion-type folds, to form a spring member 52 in at least a portion of the end 40 of the first sheet 16. The folds 54 have ridges 58 which are generally parallel to the interior 60 of the first enclosure 38, as shown in FIGS. 2*a* and 2*b*. One of ordinary skill in the art would understand that the biasing means may be shaped or formed in some other manner, for example dome shaped, or may comprise a separate component, such as a separate spring, if desired.

For example, if the first sheet 16 is not formed of a material suitable for forming the biasing means on one end, a separate, third sheet (not shown) made of a suitable material such as the polymeric materials listed above and having openings suitably aligned with the blisters 22 could be placed on top of the first sheet 16. The third sheet could extend into the first enclosure 38 and could have an end shaped as discussed above, for example, having accordion folds, to form the biasing means. It should also be appreciated by those skilled in the art that in some embodiments the biasing means may be eliminated to permit unrestricted sliding movement of the container 14 between the first and second positions.

As best shown in FIG. 2*a*, the biasing means is located within the housing 32 for biasing the container 14 toward the second position. When the container 14 is in the second position, the base 34 of the housing 32 is positioned facing the second side 28 of the second sheet 24 with the openings 36 not in registry with any of the blisters 22 to inhibit removal of the article 12 from the container 14. As best shown in FIG. 2*b*, when the container 14 is moved by an individual against the bias of the biasing means to the first position, the folds 54 of the biasing means are compressed and the blisters 22 are in registry with the openings 36 to permit removal of one or more of the articles 12 by applying pressure to the outside surface 23 of the blisters 22 to force the articles 12 to rupture or puncture the second sheet 24 and pass through the openings 36 in the base 34 of the housing 32. Thereafter, when the user releases the container 14, the compressed biasing means relaxes and moves the container 14 toward the left to the second position as shown in FIG. 2*a* to prevent further removal of the articles.

If desired, a separate third sheet (not shown) could be positioned above the first sheet 16 of the blister-type container 14 to provide printed information useful or related to the dispensing of the articles 12. For example, dosage information or date information could be applied to the third sheet.

From the foregoing description, it can be seen that the present invention comprises a child-resistant device for inhibiting removal of an article from a blister-type container. It will be appreciated by those skilled in the art that changes could be made to the embodiment described without departing from the broad invention concept thereof. For example, the device could be made without a biasing means to facilitate use of the device by disabled persons. It is understood, therefore, that this invention is not limited to the particular embodiment disclosed, but is intended to cover all modifications which are within the spirit and scope of the invention as defined by the appended claims.

I claim:

1. A device for inhibiting removal of an article from a blister-type container, said container comprising a first generally flat sheet having a first side and a second side and a blister for accommodating said article and a puncturable generally flat second sheet having a first side and a second side, said first side of said second sheet engaging a portion of said first side of said first sheet, whereby said article may be removed from said container by applying pressure to an outside surface of said blister to force said article to puncture said second sheet, said device comprising:

a housing surrounding at least a portion of said container, said housing being sized to permit movement of said container between a first position and a second position, said housing having a base positioned facing said second side of said second sheet, said base including a base opening in registry with said blister when said container is in said first position, said base opening being sized to permit passage of said article therethrough; and biasing means for biasing said container toward said second position, whereby when said container is in said second position, said base of said housing is positioned facing said second side of said second sheet to inhibit removal of said article from said container and when said container is moved by an individual against the bias of said biasing means to said first position, said blister is in registry with said base opening to permit removal of said article by applying pressure to said outside surface of said blister to force said article to puncture said second sheet and pass through said base opening.

2. A device according to claim 1, wherein said article is selected from the group consisting of pills, tablets, and capsules.

3. A device according to claim 1, wherein said first sheet is a thermoplastic material.

4. A device according to claim 3, wherein said thermoplastic material is selected from the group consisting of polyvinyl chloride, styrene, polypropylene, barrex, aclar, PET, PETG and APET.

5. A device according to claim 1, wherein said second sheet is a metallic foil.

6. A device according to claim 1, wherein said housing is selected from at least one of a thermoplastic material and a material comprising paper.

7. A device according to claim 1, wherein said housing includes a first enclosure in engagement with said base and enclosing a first end of said first sheet and said biasing means and a second enclosure in engagement with said base and enclosing a second end of said first sheet, said first enclosure having an abutment for contacting a portion of said outside surface of at least one blister and restricting movement of said container with respect to said housing.

8. A device according to claim 1, wherein said biasing means and said first sheet are formed together from the same material.

9. A device according to claim 8, wherein said biasing means comprises a shaped portion of said first sheet.

10. A device according to claim 9, wherein the shaped portion of the first sheet comprises at least one fold to establish an accordion-type spring.

11. A device according to claim 1, wherein said biasing means is in communication with at least one of said first sheet and said second sheet.

12. A device for inhibiting removal of an article from a blister-type container, said container comprising a first generally flat sheet having a first side and a second side and a blister for accommodating said article and a puncturable generally flat second sheet having a first side and a second side, said first side of said second sheet engaging a portion of said first side of said first sheet, whereby said article may be removed from said container by applying pressure to an outside surface of said blister to force said article to puncture said second sheet, said device comprising:

a housing surrounding at least a portion of said container, said housing being sized to permit movement of said container between a first position and a second position, said housing having a base positioned facing said second side of said second sheet, said base including a base opening in registry with said blister when said container is in said first position, said base opening being sized to permit passage of said article therethrough, whereby when said container is in said second position, said base of said housing is positioned facing said second side of said second sheet to inhibit removal of said article from said container and when said container is moved by an individual to said first position, said blister is in registry with said base opening to permit removal of said article by applying pressure to said outside surface of said blister to force said article to puncture said second sheet and pass through said base opening.

* * * * *